United States Patent [19]

Rathburn

[11] 4,444,254

[45] Apr. 24, 1984

[54] SLIP ASSEMBLY FOR HYDRAULIC PIPE TESTING

[76] Inventor: Lloyd C. Rathburn, 701 Falling Leaf, Friendswood, Tex. 77546

[21] Appl. No.: 383,517

[22] Filed: Jun. 1, 1982

[51] Int. Cl.[3] ..... E21B 23/00

[52] U.S. Cl. ..... 166/216; 166/138

[58] Field of Search ..... 166/216, 217, 138, 210, 166/240, 206

[56] References Cited

U.S. PATENT DOCUMENTS

| | | | |
|---|---|---|---|
| 1,892,442 | 12/1932 | Wickersham | 166/216 |
| 2,319,493 | 5/1943 | Drinkard | 166/187 |
| 2,829,718 | 4/1958 | Johns | 166/138 |
| 2,832,417 | 4/1958 | Webber | 166/216 |
| 3,288,220 | 11/1966 | Rouse | 166/138 |
| 3,298,442 | 1/1967 | Kisling | 166/331 |
| 3,493,046 | 2/1970 | Johnson et al. | 166/217 |

*Primary Examiner*—Ernest R. Purser
*Assistant Examiner*—Hoang C. Dang
*Attorney, Agent, or Firm*—Arnold, White & Durkee

[57] ABSTRACT

In accordance with an illustrative embodiment of the present invention, an anchor apparatus for preventing downward movement of a hydraulic testing unit in a tubing string includes a tubular body carrying inwardly biased slip members, a control rod telescopically received in the body for movement between an upper position enabling retraction of the slip members and a lower position where an expander member on the lower end thereof shifts said slip members outwardly into gripping engagement with the tubing wall, and a lug on the control rod above the expander member cooperable with a jay-sleeve arranged internally of the body for preventing and enabling expansion of the slip members.

5 Claims, 4 Drawing Figures

Fig. 1A
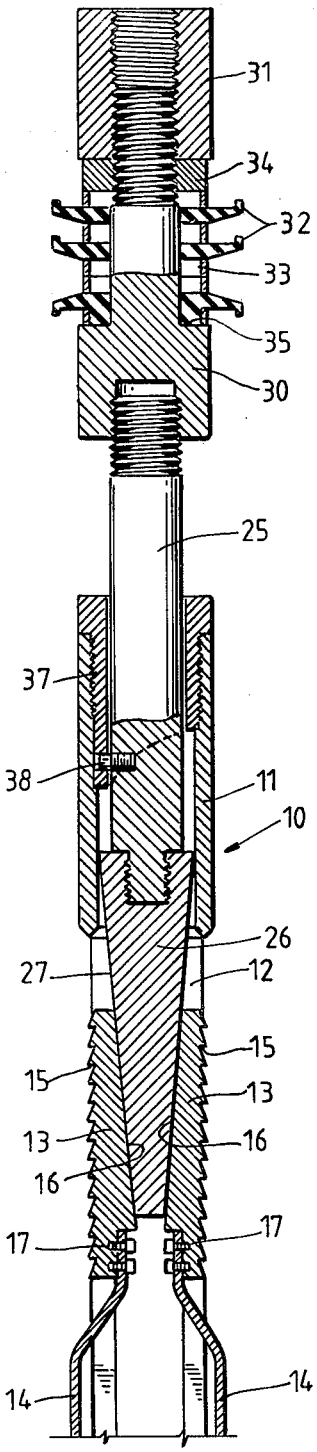
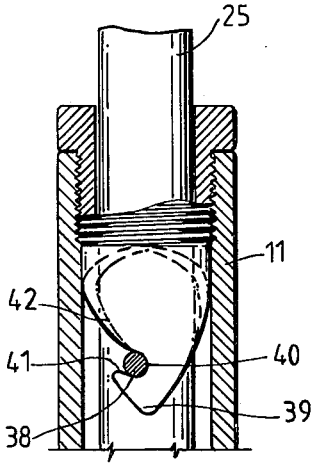
Fig. 2
Fig. 1B
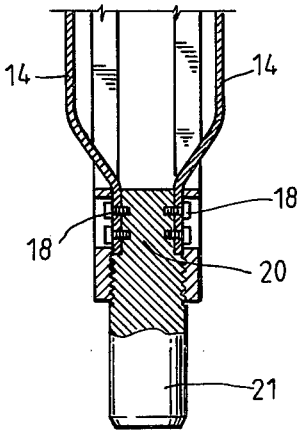
Fig. 3
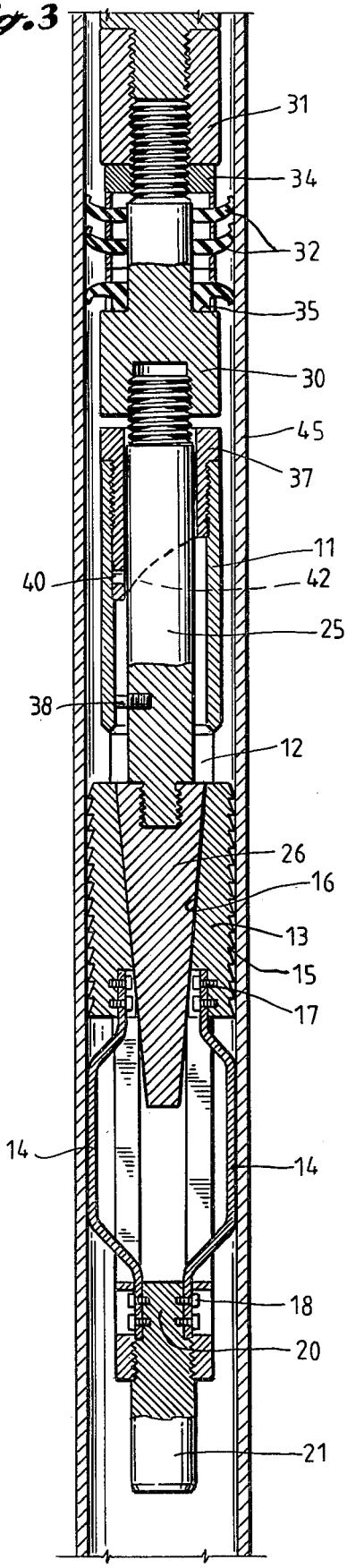

SLIP ASSEMBLY FOR HYDRAULIC PIPE TESTING

FIELD OF THE INVENTION

This invention relates generally to an anchoring device useful in pipe testing operations, and particularly to a new and improved slip assembly that can be positioned and set in a well pipe in order to prevent longitudinal movement of an associated hydraulic testing tool during a pipe testing operation.

BACKGROUND OF THE INVENTION

In a service operation such as pressure testing of pipe joints and their threaded connections as the pipe string is being assembled and lowered into a well, it is typical practice to position a hydraulic test tool having pack-off devices in the interior of pipe so that fluid under pressure can be used to detect leaks or other defects. In general it is necessary to anchor the test tool to prevent downward movement during the testing operation. The most common type of anchor or slip assembly that has been used in the past has a number of shortcomings. For example the expander cone that is used to expand the slip elements is mounted on a central rod that extends through the slip elements. Due to size constraints imposed by the relatively small internal diameter of the tubing being tested, the presence of the rod reduces the transverse dimensions of the slip elements and thereby reduces their strength and ruggedness. Another problem with prior devices has been due to the fact that the control mechanism which is manipulated to enable setting and release of the slip elements has been exposed on the exterior of the tool, which renders the same subject to malfunction when blocked by debris or the like in the well. Yet another shortcoming of prior devices has been caused by the annular configuration of the slip elements and associated expander cone, which caused the slip elements to be engaged only along an edge thereof in the set position. Such constructions reduced the holding ability of the slip elements under substantial loads, and otherwise reduced the effectiveness of the slip assembly to prevent longitudinal movement in the pipe.

It is the general object of the present invention to provide a new and improved slip assembly of the type described.

Another object of the present invention is to provide a new and improved slip assembly that is constructed and arranged in a manner that enables the use of stronger and more rugged slip elements.

Yet another object of the present invention is to provide a new and improved slip assembly having an internally arranged control means for enabling setting and release of the slip elements.

Still another object of the present invention is to provide a new and improved slip assembly that provides for contact between the expander and the slip elements throughout substantially the entire length of the latter to provide increased anchoring effectiveness.

SUMMARY OF THE INVENTION

These and other objects are attained in accordance with the concepts of the present invention through the provision of a slip assembly comprising a tubular body having normally retracted slip elements mounted thereon by resilient drag springs. A control rod telescopically received in the body has a frusto-conical expander member on its lower end which can engage and expand the slip members into gripping contact with a surrounding tubing wall in a lower position of the control rod within the body, and which enables disengagement of the slip members from the tubing wall in an upper position of the control rod with respect to the body.

The expander member is arranged with respect to the slip members such that in their retracted positions, the slip members can occupy positions closely adjacent one another and thus can have greater transverse dimensions to provide improved strength and ruggedness. A control sleeve is mounted within the upper end of the body and is arranged to coact with a lug on the control rod in the upper position of the latter to prevent setting of the slip members until such time as the control rod is raised and then lowered to disengage the lug from a pocket in the control sleeve. The control sleeve and lug are positioned internally on the body in a protected environment. The rear faces of the slip elements are formed substantially flat so as to be engaged by the conical expander member over substantially their entire axial length when set against the inner wall of the tubing to provide improved anchoring effectiveness.

BRIEF DESCRIPTION OF THE DRAWINGS

The present invention has other objects, features and advantages which will become more clearly apparent in connection with the following description of a preferred embodiment, taken in conjunction with the appended drawings in which:

FIGS. 1A and 1B are longitudinal sectional views of the present invention showing the slip elements in their retracted positions, FIG. 1B forming a lower continuation of FIG. 1A;

FIG. 2 is a fragmentary sectional view, with some parts in elevation, of the jay-slot sleeve and control pin arrangement included in the present invention; and FIG. 3 is a view similar to FIG. 1 but with the parts shown in their relative positions when the slip element are set against the tubing wall to prevent downward movement.

DESCRIPTION OF A PREFERRED EMBODIMENT

Referring initially to FIGS. 1A and 1B, a slip assembly 10 that is used to anchor a tubing tester or the like against downward movement in a section of tubing being tested includes a tubular body 11 having elongated, axially extending windows 12 cut through the opposite side walls thereof. Slip members 13 that are mounted on the upper end of bowed drag springs 14 are positioned in the respective windows 12, and are movable between inner or retracted positions and outer or extended positions with respect to the body 11. Each slip member 13 has downwardly facing wickers or teeth 15 on its outer periphery that in the outer position of the slip member bite into and grip the inner wall of the tubing. The inner wall surface 16 on each slip member 13 is substantially flat, and is inclined so as to extend upwardly and outwardly as shown. Screws 17 serve to fasten the slip member 13 to the upper ends of the drag springs 14, and additional screws 18 serve to fasten the lower ends of the drag springs to the upper portion 20 of a heel plug 21 that is threaded into the lower end of the body 11.

A control rod 25 extends downward into the body 11 and has a frusto-conical expander member 26 or "spear point" threaded to its lower end. The expander member 26 has an outer surface 27 that tapers downwardly and inwardly, and is arranged to slidably engage the inner wall surfaces 16 of the slip members 13 to cause them to be shifted outward when the expander member is moved downwardly with respect thereto. The upper end of the control rod 25 is threaded to an adapter 30 which has its upper end threaded to a collar 31 by means on which the assembly is connected to the lower end of a tester assembly. A series of elastomer packing cups 32 separated by retainer rings 33 and held by a lock nut 34 may be mounted between the collar 31 and an upwardly facing shoulder 35 on the adapter 30.

In order to retain the control rod 25 and the expander member 26 in an upper position within the body 11 as the assembly 10 is being inserted into the tubing, a "jay"-type control sleeve 37 is threaded into the upper end of the body and is arranged for cooperation with a lug 38 that is fixed to the control rod. The control sleeve 37 is formed with an inclined lower surface that provides a rounded nose 39 (FIG. 2) on the lower end thereof, and a pocket 40 is formed on one side of the nose 39. The lower surface 41 of the pocket 40 is made to incline slightly upwardly so that the lug 38 will not disengage from the pocket unless the control rod is turned clockwise with respect to the guide sleeve 37 as viewed from above. When engaged in the pocket 40, the lug transmits downward force to the body 11 to cause the entire assembly 10 to move downwardly in the tubing as will be described more fully below. In order to disengage the lug 38 from the pocket 40, it is necessary to raise the control rod 25 to cause the lug to move relatively along the inclined upper wall 42 leading to the pocket, which causes the control rod 25 to rotate somewhat relative to the housing 11. Once the lug 38 is clear of the pocket 40, the control rod 25 can be lowered within the bore of the housing 11 in order to advance the expander member 26 downwardly with respect to the slip members 13.

OPERATION

In operation, the parts are assembled as shown in the drawings and the lug 38 is engaged in the pocket 40 prior to inserting the slip assembly 10 into the tubing. the expander member 26 thus is located in its upper position with respect to the slips 13, which are retracted through engagement on the central portions of the drag springs 14 with the inner wall of the tubing. It is desirable that the drag springs 14 have sufficient stiffness that through frictional contact with the tubing they will support the weight of the assembly and necessitate that it actually be pushed downwardly in the tubing.

When it is desired to set the slip assembly 10 in order to provide an anchor against downward movement, the control rod 25 is lifted upwardly and then lowered relative to the body 11. Upward movement causes the lug 38 to disengage from the pocket 40 as it moves along the inclined surface 42 accompanied by rotation of the control rod 25, and once clear of the pocket the control rod can be moved downwardly within the body 11. Downward movement of the control rod and the expander member 26 wedges the slip members 13 outwardly as they are being held against downward movement due to the frictional restraint afforded by the drag springs 14 with the wall of the tubing 45 as shown in FIG. 3. Once the teeth 15 on the slip members 13 engage the inner wall on the tubing 45, the teeth grip the wall and prevent any further downward movement. Any additional downward force on the control rod 25 as the tubing tester is operated merely causes the slip members 13 to more tightly grip the tubing wall.

In order to release the slip assembly, it is only necessary to pick straight up on the control rod 25. The rod lifts the expander member 26 upwardly relative to the slip members 13, which are shifted inwardly by the bias of the drag springs 14 to their retracted positions. When the lug 38 comes up against the lower wall surfaces of the control sleeve 37, the entire assembly may be pulled from the tubing 45.

It now will be recognized that a new and improved slip assembly for anchoring against downward movement in a pipe string has been disclosed. Since the control rod and expander do not extend through the slip members in their normally retracted position, the slip members can have a thicker transverse section which provides a much stronger and more rugged construction than prior devices, which is less subject to breakage in use. The jay-sleeve control and lug are enclosed within the body of the assembly and thus are less subject to jamming by debris than typical external control arrangements employed in the prior art. Since the slip elements have flat internal surfaces, they are engaged throughout their length by the expander member to give uniform loading in the expanded position.

Since certain changes or modifications may be made in the disclosed embodiment without departing from the inventive concepts involved, it is the aim of the appended claims to cover all such changes and modifications falling within the true spirit and scope of the present invention.

What is claimed is:

1. A slip assembly for use in anchoring an associated tool in a section of pipe, comprising: a tubular body member; slip members mounted on said body member for movement between normally retracted positions adjacent one another and expanded positions where teeth on the outer peripheries thereof engage and grip a surrounding pipe wall; resilient means frictionally engaging the pipe wall and supporting said slip members on said body member; a control rod telescopically received in the upper end of said body member; expander means connected to the lower end of said control rod, said control rod and expander means being movable between upper positions where said expander means enables retraction of said slip members and lower positions where said expander means shifts said slip members outwardly; and control means including a sleeve mounted within the upper end of said body member and having a pocket formed therein that cooperates with lug means on said control rod for normally maintaining said rod in an upper position, said pocket being defined in part by upper and lower upwardly inclined wall surfaces, said lower wall surface preventing disengagement of said lug means from said pocket during downward movement of said assembly in the pipe, said upper wall surface causing relative rotation and disengagement of said lug means from said pocket when said control rod is moved upwardly relative to said body member.

2. The assembly of claim 1 wherein said expander member has a conical shape.

3. The assembly of claim 2 wherein said slip members have substantially flat rear wall surfaces.

4. The assembly of claim 1 wherein said resilient means comprise elongated, bowed springs, one end of each spring being attached to said body member and the other end of each spring being attached to a respective slip member.

5. The assembly of claim 4 wherein said slip members and springs are mounted on said body member below said control rod and expander means.

* * * * *